United States Patent [19]

Bhan

[11] Patent Number: 5,068,025

[45] Date of Patent: Nov. 26, 1991

[54] AROMATICS SATURATION PROCESS FOR DIESEL BOILING-RANGE HYDROCARBONS

[75] Inventor: Opindar K. Bhan, Katy, Tex.

[73] Assignee: Shell Oil Company, Houston, Tex.

[21] Appl. No.: 544,445

[22] Filed: Jun. 27, 1990

[51] Int. Cl.[5] ..... C10G 45/00

[52] U.S. Cl. ..... 208/57; 208/143; 585/270

[58] Field of Search ..... 208/57, 143; 585/270

[56] References Cited

U.S. PATENT DOCUMENTS

| | | | |
|---|---|---|---|
| 3,147,210 | 9/1964 | Hass et al. | 208/143 X |
| 3,366,684 | 1/1968 | Budd | 260/576 |
| 3,392,112 | 7/1968 | Bercik et al. | 208/143 X |
| 3,766,058 | 10/1973 | Hensley | 208/210 |
| 3,876,530 | 4/1975 | Frayer et al. | 208/210 |
| 4,016,067 | 4/1977 | Fischer | 208/89 |
| 4,016,069 | 4/1977 | Christman et al. | 208/210 |
| 4,016,070 | 4/1977 | Chistman et al. | 208/210 |
| 4,019,976 | 4/1977 | Cosyns et al. | 585/270 X |
| 4,021,330 | 5/1977 | Satchell | 208/89 |
| 4,048,060 | 9/1977 | Riley | 208/210 |
| 4,166,026 | 8/1979 | Fukui et al. | 208/210 |
| 4,392,945 | 7/1983 | Howard et al. | 208/210 |
| 4,406,779 | 9/1983 | Hensley et al. | 208/254 H |
| 4,421,633 | 12/1983 | Shih et al. | 208/59 |
| 4,431,526 | 2/1984 | Simpson et al. | 208/211 |
| 4,447,314 | 5/1984 | Banta | 208/89 |
| 4,520,128 | 5/1985 | Morales et al. | 502/210 |
| 4,530,911 | 7/1985 | Ryan et al. | 502/74 |
| 4,534,852 | 8/1985 | Washecheck et al. | 208/89 |
| 4,632,747 | 12/1986 | Ho et al. | 208/112 X |
| 4,657,664 | 4/1987 | Evans et al. | 208/112 X |
| 4,776,945 | 10/1988 | Washecheck et al. | 208/89 |
| 4,902,404 | 2/1990 | Ho | 208/57 |

OTHER PUBLICATIONS

Brunauer et al., "Adsorption of Gases in Multimolecular Layers", The Journal of American Chemical Society, vol. 60, pp. 309–319, 1938.

*Primary Examiner*—Theodore Morris
*Assistant Examiner*—William C. Diemler

[57] ABSTRACT

In a process for the concomitant hydrogenation of aromatics and sulfur-bearing hydrocarbons in an aromatics- and sulfur-bearing, diesel boiling-range hydrocarbon feedstock, the feedstock is contacted at a temperature between about 600° F. and about 750° F. and a pressure between about 600 psi and about 2500 psi in the presence of added hydrogen with a first catalyst bed containing a hydrotreating catalyst containing nickel, tungsten and optionally phosphorous supported on an alumina support, and, after contact with the first catalyst bed, the hydrogen and feedstock without modification, is passed from the first catalyst bed to a second catalyst bed where it is contacted at a temperature between about 600° F. and about 750° F. and a pressure between about 600 psi and about 2500 psi with a hydrotreating catalyst containing cobalt and/or nickel, molybdenum and optionally phosphorous supported on an alumina support.

15 Claims, No Drawings

AROMATICS SATURATION PROCESS FOR DIESEL BOILING-RANGE HYDROCARBONS

FIELD OF THE INVENTION

This invention relates to a hydrotreating process for the saturation of aromatics in diesel boiling-range hydrocarbon feedstocks.

BACKGROUND OF THE INVENTION

Environmental regulations are requiring that the aromatics and sulfur content of diesel fuels be reduced. Reduction of the aromatics and sulfur content will result in less particulate and sulfur dioxide emissions from the burning of diesel fuels. Unfortunately, a hydrotreating catalyst that is optimized for hydrodesulfurization will not be optimized for aromatics saturation and vice versa. Applicant has developed a "stacked" or multiple bed hydrotreating system comprising a Ni-W/alumina catalyst "stacked" on top of a Co and/or Ni-Mo/alumina catalyst which offers both cost and activity advantages over the individual catalysts for combined hydrodesulfurization and aromatics saturation.

U.S. Pat. No. 3,392,112 discloses a two-stage hydrotreating process for sulfur-containing petroleum fractions wherein the first stage contains a sulfur-resistant catalyst such as nickel-tungsten supported on alumina and the second stage catalyst is reduced nickel composited with a diatomaceous earth such as kieselguhr.

U.S. Pat. No. 3,766,058 discloses a two-stage process for hydrodesulfurizing high-sulfur vacuum residues. In the first stage some of the sulfur is removed and some hydrogenation of feed occurs, preferably over a cobalt-molybdenum catalyst supported on a composite of ZnO and $Al_2O_3$. In the second stage the effluent is treated under conditions to provide hydrocracking and desulfurization of asphaltenes and large resin molecules contained in the feed, preferably over molybdenum supported on alumina or silica, wherein the second catalyst has a greater average pore diameter than the first catalyst.

U.S. Pat. No. 3,876,530 teaches a multi-state catalytic hydrodesulfurization and hydrodemetallization of residual petroleum oil in which the initial stage catalyst has a relatively low proportion of hydrogenation metals and in which the final stage catalyst has a relatively high proportion of hydrogenation metals.

U.S. Pat. No. 4,016,067 discloses a dual bed hydrotreating process wherein in the first bed the catalytic metals are supported on delta or theta phase alumina and wherein both catalysts have particular requirements of pore distribution.

U.S. Pat. No. 4,016,069 discloses a two-stage process for hydrodesulfurizing metal- and sulfur-containing asphaltenic heavy oils with an interstage flashing step and with partial feed oil bypass around the first stage.

U.S. Pat. No. 4,016,070 also discloses a two-stage process with an interstage flashing step.

U.S. Pat. No. 4,012,330 teaches a two-bed hydrotreating process with additional hydrogen injection between the beds.

U.S. Pat. No. 4,048,060 discloses a two-stage hydrodesulfurization and hydrodemetallization process utilizing a different catalyst in each stage, wherein the second stage catalyst has a larger pore size than the first catalyst and a specific pore size distribution.

U.S. Pat. No. 4,166,026 teaches a two-step process wherein a heavy hydrocarbon oil containing large amounts of asphaltenes and heavy metals is hydrodemetallized and selectively cracked in the first step over a catalyst which contains one or more catalytic metals supported on a carrier composed mainly of magnesium silicate. The effluent from the first step, with or without separation of hydrogen-rich gas, is contacted with hydrogen in the presence of a catalyst containing one or more catalytic metals supported on a carrier preferably alumina or silica-alumina having a particular pore volume and pore size distribution. This two-step method is claimed to be more efficient than a conventional process wherein a residual oil is directly hydrosulfurized in a one-step treatment.

U.S. Pat. No. 4,392,945 discloses a two-stage hydrorefining process for treating heavy oils containing certain types of organic sulfur compounds by utilizing a specific sequence of catalysts with interstage removal of $H_2S$ and $NH_3$. A nickel-containing conventional hydrorefining catalyst is present in the first stage. A cobalt-containing conventional hydrorefining catalyst is present in the second stage.

U.S. Pat. No. 4,406,779 teaches a two-bed reactor for hydrodenitrification. The catalyst in the first bed can comprise, for example, phosphorus-promoted nickel and molybdenum on an alumina support and the catalyst for the second bed can comprise, for example, phosphorus-promoted nickel and molybdenum on a silica-containing support.

U.S. Pat. No. 4,421,633 teaches a multi-catalyst bed reactor containing a first bed large-pore catalyst having majority of its pores much larger than 100 Å in diameter and a second bed of small-pore catalyst having a pore size distribution which is characterized by having substantially all pore less than 80 Å in diameter.

U.S. Pat. No. 4,431,526 teaches a multi-catalyst bed system in which the first catalyst has an average pore diameter at least about 30 Å larger than the second catalyst. Both catalysts have pore size distributions wherein at least about 90% of the pore volume is in pores from about 100 to 300 Å.

U.S. Pat. No. 4,447,314 teaches a multi-bed catalyst system in which the first catalyst has at least 60% of its pore volume in pores having diameters of about 100 to 200 Å and a second catalyst having a quadralobe shape in at least 50% of its pore volume in pores having diameters of 30 to 100 Å.

U.S. Pat. Nos. 4,534,852 and 4,776,945 disclose that Ni/Mo/P and Co/Mo catalysts in a stacked bed arrangement provide significant advantages when hydrotreating certain types of coke-forming oils.

SUMMARY OF THE INVENTION

The instant invention comprises a process for the concomitant hydrogenation of aromatics and sulfur-bearing hydrocarbons in an aromatics-and sulfur-bearing hydrocarbon feedstock having substantially all of its components boiling in the range of about 200° F. to about 900° F. which process comprises:

(a) contacting at a temperature between about 600° F. and about 750° F. and a pressure between about 600 psi and about 2500 psi in the presence of added hydrogen said feedstock with a first catalyst bed containing a hydrotreating catalyst comprising nickel, tungsten and optionally phosphorous supported on an alumina support, and (b) passing the hydrogen and feedstock without modification, from the first catalyst bed to a second catalyst bed where it is contacted at a temperature between about 600° F. and about 750° F. and a pressure between about 600 psi and about 2500 psi with a hydrotreating catalyst comprising cobalt and/or nickel, molybdenum and optionally phosphorous supported on an alumina support.

The instant process is particularly suited for hydrotreating feedstocks containing from about 0.01 to about 2 percent by weight of sulfur. For sulfur-deficient feedstocks, sulfur-containing compounds may be added to the feedstock to provide a sulfur level of 0.01–2 percent by weight.

The dual catalyst bed process of the instant invention provides for better aromatics saturation at lower hydrogen partial pressures than does a process utilizing only one of the catalysts utilized in the dual bed system.

DESCRIPTION OF THE PREFERRED EMBODIMENTS

The instant invention relates to a process for reducing the sulfur and aromatics content of a diesel boiling-range hydrocarbon feedstock by contacting the feedstock in the presence of added hydrogen with a two bed catalyst system at hydrotreating conditions, i.e., at conditions of temperature and pressure and amounts of added hydrogen such that significant quantities of aromatics are saturated and significant quantities of sulfur are removed from the feedstock. Nitrogen-containing impurities, when present, are also significantly reduced.

The feedstock to be utilized is a diesel boiling-range hydrocarbon feedstock having substantially all, that is, greater than about 90 percent by weight, of its components boiling between about 200° F. and about 900° F., preferably between about 250° F. and about 800° F. and more preferably between about 300° F. and about 750° F. and which contains from about 0.01 to about 2, preferably from about 0.05 to about 1.5 percent by weight of sulfur present as organosulfur compounds. Feedstocks with very low or very high sulfur contents are generally not suitable for processing in the instant process. Feedstocks with very high sulfur contents can be subjected to a separate hydrodesulfurization process in order to reduce their sulfur contents to about 0.01–2, preferably 0.05–1.5 percent by weight prior to being processed by the instant process. Feedstocks with very low sulfur contents can be adjusted to sulfur levels of about 0.01–2, preferably 0.05–1.5 percent by weight by the addition of suitable amounts of sulfur containing compounds. Suitable compounds include, for example, the mercaptans, particularly the alkyl mercaptans; sulfides and disulfides such as, for example, carbon disulide, dimethyl sulfide, dimethyldisulfide, etc.; thiophenic compounds such as methyl thiophene, benzothiophene, etc., and polysulfides of the general formula $R\text{-}S_{(n)}\text{-}R'$. There are numerous other sulfur-containing materials that can be utilized to adjust the sulfur content of the feedstock. U.S. Pat. No. 3,366,684, issued Jan. 30, 1968, incorporated by reference herein, lists a number of suitable sulfur-containing compounds.

The instant process utilizes two catalyst beds in series. The first catalyst bed is made up of a hydrotreating catalyst comprising nickel, tungsten and optionally phosphorous supported on an alumina support and the second catalyst bed is made up of a hydrotreating catalyst comprising a hydrogenating metal component selected from cobalt, nickel and mixtures thereof, molybdenum and optionally phosphorous supported on an alumina support. The term "first" as used herein refers to the first bed with which the feedstock is contacted and "second" refers to the bed with which the feedstock, after passing through the first bed, is next contacted. The two catalyst beds may be distributed through two or more reactors, or, in the preferred embodiment, they are contained in one reactor. In general the reactor(s) used in the instant process is used in the trickle phase mode of operation, that is, feedstock and hydrogen are fed to the top of the reactor and the feedstock trickles down through the catalyst bed primarily under the influence of gravity. Whether one or more reactors are utilized, the feedstock with added hydrogen is fed to the first catalyst bed and the feedstock as it exits from the first catalyst bed is passed directly to the second catalyst bed without modification. "Without modification" means that no sidestreams of hydrocarbon materials are removed from or added to the stream passing between the two catalyst beds. Hydrogen may be added at more than one position in the reactor(s) in order to maintain control of the temperature. When both beds are contained in one reactor, the first bed is also referred to as the "top" bed.

The volume ratio of the first catalyst bed to the second catalyst bed is primarily determined by a cost effectiveness analysis and the sulfur content of the feed to be processed. The cost of of the first bed catalyst which contains more expensive tungsten is approximately two to three times the cost of the second bed catalyst which contains less expensive molybdenum. The optimum volume ratio will depend on the particular feedstock sulfur content and will be optimized to provide minimum overall catalyst cost and maximum aromatics saturation. In general terms the volume ratio of the first catalyst bed to the second catalyst bed will range from about 1:4 to about 4:1, more preferably from about 1:3 to about 3:1, and most preferably from about 1:2 to about 2:1.

The catalyst utilized in the first bed comprises nickel, tungsten and 0–5% wt phosphorous (measured as the element) supported on a porous alumina support preferably comprising gamma alumina. It contains from about 1 to about 5, preferably from about 2 to about 4 percent by weight of nickel (measured as the metal); from about 15 to about 35, preferably from about 20 to about 30 percent by weight of tungsten (measured as the metal) and, when present, preferably from about 1 to about 5, more preferably from about 2 to about 4 percent by weight of phosphorous (measured as the element), all per total weight of the catalyst. It will have a surface area, as measured by the B.E.T. method (Brunauer et al, J Am. Chem. Soc., 60, 309–16 (1938)) of greater than about 100 $m^2/g$ and a water pore volume between about 0.2 to about 0.6, preferably between about 0.3 to about 0.5.

The catalyst utilized in the second bed comprises a hydrogenating metal component selected from cobalt, nickel and mixtures thereof, molybdenum and 0–5% wt phosphorous (measured as the element) supported on a porous alumina support preferably comprising gamma alumina. It contains from about 1 to about 5, preferably from about 2 to about 4 percent by weight of hydrogenating metal component (measured as the metal); from about 8 to about 20, preferably from about 12 to about 16 percent by weight of molybdenum (measured as the metal) and, when present, preferably from about 1 to about 5, more preferably from about 2 to about 4 percent by weight of phosphorous (measured as the element), all per total weight of the catalyst. It will have a surface area, as measured by the B.E.T. method (Brunauer et al, J. Am. Chem. Soc., 60, 309–16 (1938)) of greater than about 120 $m^2/g$ and a water pore volume between about 0.2 to about 0.6, preferably between about 0.3 to about 0.5. Cobalt and nickel are know in the art to be substantial equivalents in molybdenum-containing hydrotreating catalysts.

The catalyst utilized in both beds of the instant process are catalysts that are known in the hydrocarbon hydroprocessing art. These catalysts are made in a conventional fashion as described in the prior art. For example porous alumina pellets can be impregnated with solution(s) containing cobalt, nickel, tungsten or molybdenum and phosphorous compounds, the pellets subsequently dried and calcined at elevated temperatures. Alternately, one or more of the components can be incorporated into an alumina powder by mulling, the mulled powder formed into pellets and calcined at elevated temperature. Combinations of impregnation and mulling can be utilized. Other suitable methods can be found in the prior art. Non-limiting examples of catalyst preparative techniques can be found in U.S. Pat No. 4,530,911, issued July 23, 1985, and U.S. Pat. No. 4,520,128, issued May 28, 1985, both incorporated by reference herein. The catalysts are typically formed into various sizes and shapes. They may be suitably shaped into particles, chunks, pieces, pellets, rings, spheres, wagon wheels, and polylobes, such as bilobes, trilobes and tetralobes.

The two above-described catalysts are normally presulfided prior to use. Typically, the catalysts are presulfided by heating in $H_2S/H_2$ atmosphere at elevated temperatures. For example, a suitable presulfiding regimen comprises heating the catalysts in a hydrogen sulfide/hydrogen atmosphere (5% v $H_2S$/95% v $H_2$) for about two hours at about 700° F. Other methods are also suitable for presulfiding and generally comprise heating the catalysts to elevated temperatures (e.g., 400°–750° F.) in the presence of hydrogen and a sulfur-containing material.

The hydrogenation process of the instant invention is effected at a temperature between about 600° F. and 750° F., preferably between about 620° F. and about 750° F. under pressures above about 40 atmospheres. The total pressure will typically range from about 600 to about 2500 psig. The hydrogen partial pressure will typically range from about 500 to about 2200 psig. The hydrogen feed rate will typically range from about 1000 to about 5000 SCF/BBL. The feedstock rate will typically have a liquid hourly space velocity ("LHSV") ranging from 0.1 to about 5, preferably from about 0.2 to about 3.

The ranges and limitations provided in the instant specification and claims are those which are believed to particularly point out and distinctly claim the instant invention. It is, however, understood that other ranges and limitations that perform substantially the same function in substantially the same way to obtain the same or substantially the same result are intended to be within the scope of the instant invention as defined by the instant specification and claims.

The invention will be described by the following examples which are provided for illustrative purposes and are not to be construed as limiting the invention.

The catalysts used to illustrate the instant invention are given in Table 1 below.

TABLE 1

| HYDROGENATION CATALYSTS | | |
|---|---|---|
| Metals, Wt. % | CATALYST A | CATALYST B |
| Ni | 2.99 | 2.58 |
| W | 25.81 | -0- |
| Mo | -0- | 14.12 |
| P | 2.60 | 2.93 |
| Support | gamma alumina | gamma alumina |
| Surface Area, $m^2/g$ | 133 | 164 |
| Water Pore Vol., ml/g | 0.39 | 0.44 |

The feedstock utilized to illustrate the instant invention is detailed in Table 2 below.

TABLE 2

| PROPERTIES OF FEEDSTOCK | |
|---|---|
| Physical Properties | |
| Density, 60° F. | 0.8925 |
| API | 27.04 |
| Refrective Index, 20° C. | 1.4947 |
| Pour Point | −5.8° F. |
| Flash Point | 195.8° F. |
| Cetane Index (ASTM 976-80) | 38.6 |
| Elemental Content | |
| Hydrogen | 12.029 wt. % |
| Carbon | 87.675 wt. % |
| Oxygen | 520 ppm |
| Nitrogen | 148 ppm |
| Sulfur | 400 ppm |
| Aromatic Content | |
| FIA (ASTM 1319-84) | 59.8 vol. % |

| Boiling Point Distribution | | | |
|---|---|---|---|
| ASTM D-86 | | ASTM D-2887 | |
| IBP | 393° F. | IBP | 343° F. |
| 5.0 VOL. % | 434 | 5.0 WT. % | 409 |
| 10.0 | 467 | 10.0 | 443 |
| 20.0 | 490 | 20.0 | 482 |
| 30.0 | 510 | 30.0 | 513 |
| 40.0 | 530 | 40.0 | 543 |
| 50.0 | 551 | 50.0 | 572 |
| 60.0 | 572 | 60.0 | 598 |
| 70.0 | 593 | 70.0 | 624 |
| 80.0 | 617 | 80.0 | 653 |
| 90.0 | 651 | 90.0 | 693 |
| FBP | 688 | FBP (99.5) | 781 |

To illustrate the instant invention and to perform comparative tests, a vertical micro-reactor having a height of 28.5 inches and an internal volume of 6.93 cubic inches was used to hydrotreat the feedstock noted in Table 2. Three types of catalyst configurations were tested utilizing the catalysts noted in Table 1: a) 40 cc of Catalyst A diluted with 40 cc of 60/80 mesh silicon carbide particles, b) 40 cc of Catalyst B diluted with 40 cc of 60/80 mesh silicon carbide particles and c) 20 cc of Catalyst A diluted with 20 cc of 60/80 mesh silicon carbide particles placed on top of 20 cc of Catalyst B diluted with 20 cc of 60/80 mesh silicon carbide particles. The catalysts were presulfided in the reactor by heating them to about 700° F. and holding at such temperature for about two hours in a 95 vol. % hydrogen-5 vol. % hydrogen sulfide atmosphere flowing at a rate of about 60 liters/hour.

After catalyst presulfidization, the catalyst beds were stabilized by passing the feedstock from Table 2 with its sulfur content adujusted to 1600 ppm by the addition of benzothiophene over the catalyst bed for over about 48 hours at about 600° F. at a system pressure of about 1500 psig and a liquid volume hourly space velocity of about 1 $hour^{-1}$. Hydrogen gas was supplied on a once-through basis at a rate of about 3,000 SCF/BBL. The reactor temperature was gradually increased to about 630° F. and allowed to stabilize. During this period, spot samples were collected daily and analyzed for refractive index ("RI"). The catalyst(s) was considered to have stabilized once product RI was stable.

During the course of this study, sulfur contents of the feedstock were adjusted by adding suitable amounts of benzothiophene and reactor temperature, system pressure. LHSV. and hydrogen gas rate were adjusted to the conditions indicated in Tables 3, 4 and 5. Product liquid samples were collected at each process condition and analyzed for S, N, and aromatics (by fluorescent indicator adsorbtion technique ("FIA"); ASTM D-1319-84). These results are shown in Tables 3, 4 and 5.

TABLE 3

CATALYST BED CONTAINING CATALYST A

| Run No. | S in Feed, ppm | Cat.[1] Age, hr. | LHSV $hr^{-1}$ | Run Temp. °F. | Total Press. Psig | Gas Rate SCF/BBL | Product N, ppm | Product S, ppm | FIA[2] Conv. |
|---|---|---|---|---|---|---|---|---|---|
| A1 | 1600 | 2110 | 1.00 | 700 | 1500 | 3,000 | — | 1.0 | 61.1 |
| A2 | 1600 | 2591 | 1.01 | 700 | 1500 | 3,000 | 1.0 | 1.0 | 67.1 |
| A3 | 1600 | 3024 | 1.00 | 700 | 1500 | 3,000 | — | — | 66.4 |
| A4 | 1600 | 3672 | 0.98 | 700 | 1100 | 3,000 | — | 5.0 | 25.0 |
| A5 | 1600 | 3814 | 1.01 | 700 | 700 | 3,000 | — | 37.0 | −2.9 |
| A6 | 10,350 | 3560 | 1.00 | 700 | 1500 | 3,000 | 1.0 | 6.0 | 38.7 |

[1]Catalyst age represents the time that the catalyst bed has been operated since it reached temperature of 400° F.
[2]% aromatics conversion by FIA (ASTM D-1319-84).

Conversion defined as $\frac{\text{Vol. \% FIA content of feed} - \text{Vol. \% FIA content of product}}{\text{Vol. \% FIA content of feed}}$

TABLE 4

CATALYST BED CONTAINING CATALYST B

| Run No. | S in Feed, ppm | Cat.[1] Age, hr. | LHSV $hr^{-1}$ | Run Temp. °F. | Total Press. Psig | Gas Rate SCF/BBL | Product N, ppm | Product S, ppm | FIA[2] Conv. |
|---|---|---|---|---|---|---|---|---|---|
| B1 | 1600 | 384 | 1.00 | 700 | 1100 | 3,000 | 1.0 | 2.2 | 26.7 |
| B2 | 1600 | 462 | 0.99 | 700 | 700 | 3,000 | 16.0 | 7.9 | −1.2 |
| B3 | 1600 | 503 | 1.01 | 700 | 1500 | 3,000 | 1.0 | 2.0 | 36.5 |
| B4 | 10,350 | 631 | 1.02 | 700 | 1500 | 3,000 | <1 | 3.5 | 52.9 |
| B5 | 10,350 | 647 | 1.02 | 700 | 1500 | 3,000 | <1 | 2.3 | 53.3 |

[1]Catalyst age represents the time that the catalyst bed has been operated since it reached temperature of 400° F.
[2]% aromatics conversion by FIA (ASTM D-1319-84).

Conversion defined as $\frac{\text{Vol. \% FIA content of feed} - \text{Vol. \% FIA content of product}}{\text{Vol. \% FIA content of feed}}$

TABLE 5

CATALYST BED CONTAINING CATALYST A ON TOP OF CATALYST B

| Run No. | S in Feed, ppm | Cat.[1] Age, hr. | LHSV $hr^{-1}$ | Run Temp. °F. | Total Press. Psig | Gas Rate SCF/BBL | Product N, ppm | Product S, ppm | FIA[2] Conv. |
|---|---|---|---|---|---|---|---|---|---|
| A/B1 | 1600 | 330 | 0.99 | 700 | 1500 | 3,000 | <1 | <1 | 58.6 |
| A/B2 | 1600 | 489 | 1.00 | 700 | 1500 | 3,000 | <1 | 12 | 63.0 |
| A/B3 | 1600 | 561 | 1.00 | 700 | 1100 | 3,000 | 5 | 11 | 40.9 |
| A/B4 | 1600 | 657 | 1.01 | 700 | 700 | 3,000 | 25 | 20 | 2.1 |
| A/B5 | 1600 | 848 | 0.39 | 700 | 700 | 3,000 | <1 | 7 | 14.9 |
| A/B6 | 1600 | 978 | 0.98 | 700 | 1500 | 3,000 | 1 | 14 | 51.2 |
| A/B7 | 10,350 | 1148 | 1.01 | 700 | 1500 | 3,000 | <1 | 14 | 49.2 |
| A/B8 | 10,350 | 1170 | 1.02 | 700 | 1500 | 3,000 | <1 | 17 | 50.6 |
| A/B9 | 10,350 | 1216 | 0.99 | 700 | 1100 | 3,000 | 2 | 20 | 26.5 |
| A/B10 | 10,350 | 1264 | 1.02 | 700 | 700 | 3,000 | 19 | 28 | 9.9 |
| A/B11 | 10,350 | 1314 | 0.36 | 700 | 700 | 3,000 | 1 | 22 | 30.5 |
| A/B12 | 10,350 | 1362 | 1.00 | 700 | 1500 | 3,000 | <1 | 20 | 48.2 |
| A/B13 | 1600 | 1416 | 0.97 | 700 | 1500 | 3,000 | <1 | 19 | 61.6 |

[1]Catalyst age represents the time that the catalyst bed has been operated since it reached temperature of 400° F.
[2]% aromatics conversion by FIA (ASTM D-1319-84).

Conversion defined as $\frac{\text{Vol. \% FIA content of feed} - \text{Vol. \% FIA content of product}}{\text{Vol. \% FIA content of feed}}$ As can be seen from the above data, the instant invention provides for enhanced aromatics saturation over Catalyst A at high sulfur levels and over Catalyst B at low sulfur levels.

What is claimed is:

1. A process for the concomitant hydrogenation of aromatics and sulfur-bearing hydrocarbons in an aromatics- and sulfur-bearing hydrocarbon feedstock having substantially all of its components boiling in the range of about 200° F. to about 900° F. which process comprises:

(a) contacting at a temperature between about 600° F. and about 750° F. and a pressure between about 650 psi and about 2500 psi in the presence of added hydrogen said feedstock with a first catalyst bed containing a hydrotreating catalyst comprising nickel, tungsten and phosphorus on an alumina support, in which the nickel content ranges from 1 to 5 percent by weight of the total catalyst, measured as the metal, the tungsten content ranges from 10 to 35 percent by weight of the total catalyst measured as the metal and the phosphorus content ranges from 1 to 5 percent by weight of the total catalyst;

(b) passing the hydrogen and feedstock without modification, from the first catalyst bed to a second catalyst bed where it is contacted at a temperature between about 600° F. and about 750° F. and a pressure between about 600 psi and about 2500 psi with a hydrotreating catalyst comprising a hydrogenating metal component selected from cobalt, nickel and mixtures thereof, molybdenum and phosphorus on an alumina support, in which the hydrogenating metal component content ranges from 1 to 5 percent by weight of the total catalyst, measured as the metal, the molybdenum content ranges from 8 to 20 percent by weight of the total catalyst, measured as the metal and the phosphorus content ranges from 1 to 5 percent by weight of the total catalyst.

2. The process of claim 1 wherein the support for the catalyst in the first catalyst bed has a surface area greater than about 100 $m^2/g$ and a water pore volume ranging from about 0.02 to about 0.6 cc/g and the support for the catalyst in the second catalyst bed has a surface area greater than about 120 $m^2/g$ and a water pore volume ranging from about 0.2 to about 0.6 cc/g.

3. The process of claim 2 wherein the supports for both catalysts have water pore volumes ranging between from 0.3 to about 0.5 cc/g.

4. The process of claim 2 wherein the supports for both catalysts comprise gamma alumina.

5. The process of claim 1 wherein the sulfur content of the feedstock ranges from about 0.01 to about 2 percent by weight.

6. The process of claim 6 wherein the sulfur content of the feedstock ranges from about 0.05 to about 1.5 percent by weight.

7. The process of claim 1 wherein the hydrogenation of the feedstock takes place at a hydrogen partial pressure ranging from about 500 to about 2200 psig, feedstock is provided at a liquid hourly space velocity ranging from about 0.1 to about 5 $hour^{-1}$ and added hydrogen is provided at a feed rate ranging from about 1000 to about 5000 SCF/BBL.

8. The process of claim 7 wherein the sulfur content of the feedstock ranges from about 0.01 to about 2 percent by weight.

9. The process of claim 8 wherein the sulfur content of the feedstock ranges from about 0.05 to about 1.5 percent by weight.

10. The process of any one of claims 1 wherein in the catalyst in the first bed the nickel content ranges from about 2 to about 4 percent by weight of the total catalyst, measured as the metal; the tungsten content ranges from about 20 to about 30 percent by weight of the total catalyst, measured as the metal; and the phosphorous content ranges from about 2 to about 4 percent by weight of the total catalyst, measured as the element and wherein in the catalyst in the second bed the hydrogenating metal component content ranges from about 2 to about 4 percent by weight of the total catalyst, measured as the metal; the molybdenum content ranges from about 12 to about 16 percent by weight of the total catalyst, measured as the metal and the phosphorus content ranges from about 2 to about 4 percent by weight of the total catalyst, measured as the element.

11. The process of claim 10 wherein the sulfur content of the feedstock ranges from about 0.01 to about 2 percent by weight.

12. The process of claim 11 wherein the sulfur content of the feedstock ranges from about 0.05 to about 1.5 percent by weight.

13. The process of claim 10 wherein the hydrogenation of the feedstock takes place at a hydrogen partial pressure ranging from about 500 to about 2200 psig, feedstock is provided at a liquid hourly space velocity ranging from about 0.1 to about 5 $hour^{-1}$ and added hydrogen is provided at a feed rate ranging from about 1000 to about 5000 SCF/BBL.

14. The process of claim 13 wherein the sulfur content of the feedstock ranges from about 0.01 to about 2 percent by weight.

15. The process of claim 14 wherein the sulfur content of the feedstock ranges from about 0.05 to about 1.5 percent by weight.

* * * * *